US009192251B1

(12) United States Patent
Theisen et al.

(10) Patent No.: US 9,192,251 B1
(45) Date of Patent: Nov. 24, 2015

(54) DOUBLE END FRAME

(71) Applicant: Target Brands, Inc., Minneapolis, MN (US)

(72) Inventors: Jennifer A. Theisen, Crystal, MN (US); Douglas Stukenborg, Eden Prairie, MN (US); Robert Charles Wenger, St. Francis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/298,159

(22) Filed: Jun. 6, 2014

(51) Int. Cl.

| | |
|---|---|
| ***A47F 5/08*** | (2006.01) |
| ***A47F 5/00*** | (2006.01) |
| ***A47F 5/10*** | (2006.01) |
| ***A47B 47/02*** | (2006.01) |

(52) U.S. Cl.
CPC ..... *A47F 5/0823* (2013.01); *A47B 47/027* (2013.01); *A47F 5/0018* (2013.01); *A47F 5/0807* (2013.01); *A47F 5/0846* (2013.01); *A47F 5/10* (2013.01)

(58) Field of Classification Search
CPC ... A47F 5/0823; A47F 5/0869; A47F 5/0876; A47F 5/0815; A47F 5/807; A47F 5/10; A47F 5/08; A47F 5/0018; A47B 47/00; A47B 47/02; A47B 47/021; A47B 47/027; A47B 47/03
USPC ..... 211/57.1, 59.1, 87.01, 189, 186, 94.01, 211/134, 153, 187, 54.1
See application file for complete search history.

(56) References Cited

U.S. PATENT DOCUMENTS

| | | | | | |
|---|---|---|---|---|---|
| 2,991,889 | A | * | 7/1961 | Levy et al. | 211/190 |
| 3,148,638 | A | * | 9/1964 | Shelor | 108/108 |
| 3,192,306 | A | * | 6/1965 | Skonnord | 174/16.1 |
| 3,485,382 | A | | 9/1967 | Larson | |
| 3,883,004 | A | | 5/1975 | Slaga | |
| 3,971,477 | A | * | 7/1976 | Bruderly et al. | 211/189 |
| 4,046,083 | A | * | 9/1977 | Murdoch et al. | 108/107 |
| 4,444,322 | A | * | 4/1984 | Lee | 211/190 |
| 4,450,775 | A | | 5/1984 | Brendle | |
| 5,096,648 | A | * | 3/1992 | Johnson et al. | 264/245 |
| D336,183 | S | * | 6/1993 | Klein, III | D6/683.1 |
| 5,505,319 | A | | 4/1996 | Todd, Jr. | |
| 5,529,192 | A | * | 6/1996 | Conen et al. | 211/189 |
| 6,006,925 | A | * | 12/1999 | Sevier | 211/26 |

(Continued)

FOREIGN PATENT DOCUMENTS

GB 1323226 A * 7/1973

OTHER PUBLICATIONS

Lozier, Wiregird End Panels, Nov. 1, 2007 Pages from https_web.archive.org_web_20121030153052_http_www.lozier.com_wp-content_uploads_500s.pdf.*
Photo of Festival Foods Display Rack, Aug. 2013.
Longs Drug, 3-Sided Endcap Concept Drawing, May 4, 2004.
Shopko, 3 Way End Cap, Sep. 2, 2011.

(Continued)

*Primary Examiner* — Brian Glessner
*Assistant Examiner* — Babajide Demuren
(74) *Attorney, Agent, or Firm* — Leanne Taveggia Farrell; Westman, Champlin & Koehler, P.A.

(57) ABSTRACT

A fixture has a front frame with a front, a side and a back, wherein the side extends from the front to the back. A side panel holder is mounted next to the front frame such that a wall of the side panel holder covers the back of the front frame proximate an edge where the back of the front frame meets the side of the front frame. A side panel is positioned within the side panel holder.

17 Claims, 13 Drawing Sheets

(56) References Cited

U.S. PATENT DOCUMENTS

| | | | | |
|---|---|---|---|---|
| 6,193,083 | B1 * | 2/2001 | Wood | 211/87.01 |
| 6,340,091 | B1 | 1/2002 | Romeo et al. | |
| 6,427,857 | B1 * | 8/2002 | Adams et al. | 211/189 |
| 6,942,110 | B2 | 9/2005 | Martins | |
| 7,153,748 | B2 | 12/2006 | Vosbikian | |
| 7,261,214 | B2 | 8/2007 | Wagner et al. | |
| 7,845,501 | B1 | 12/2010 | Fosburg et al. | |
| 2004/0069733 | A1 * | 4/2004 | Leclerc et al. | 211/187 |
| 2005/0173359 | A1 * | 8/2005 | Wagner et al. | 211/90.02 |
| 2007/0125730 | A1 | 6/2007 | McLaughlin et al. | |
| 2007/0170139 | A1 * | 7/2007 | Clark et al. | 211/189 |
| 2008/0006595 | A1 * | 1/2008 | Black | 211/181.1 |
| 2008/0237169 | A1 | 10/2008 | May | |
| 2011/0192812 | A1 * | 8/2011 | Weigand et al. | 211/85.8 |
| 2013/0284684 | A1 * | 10/2013 | Stukenberg et al. | 211/59.2 |
| 2014/0353269 | A1 * | 12/2014 | Trinh et al. | 211/183 |

OTHER PUBLICATIONS

Lozier, Display Rack, Feb. 4, 2014.
Lozier, Pre-Assembled 3 Way End Cap, Dec. 18, 2010.
Lozier, Pre-Assembled 3 Way End Cap, Aug. 27, 2010.
Lozier, CDA Display Rack, Apr. 22, 2008.
Lozier, Three Way End Cap Concept; Feb. 21, 2006.
Lozier, Installation Instructions, Three Way Top Stabilizer, Oct. 21, 2013.
Lozier, Three Way End Cap, Feb. 21, 2006.
Lozier, Cat Treat Endcap, Nov. 4, 2013.
Lozier, 3 Way End Cap, Sep. 2, 2011.
Lozier, 3Way-684, Jul. 25, 2013.
Lozier, Pallet Jack Base, Feb. 4, 2014.
Lozier, 3 Sided End Cap, Feb. 11, 2011.
Topco, Three Way End Cap Concept, Feb. 21, 2006.

* cited by examiner

DOUBLE END FRAME

BACKGROUND

Retail stores use a variety of display fixtures to present products to customers for purchase. These display fixtures can support the product, indicate the product price and include signage, graphics and lighting for highlighting the product. Exemplary display structures include shelves, trays, racks, peg hooks, tables and other similar structures.

The discussion above is merely provided for general background information and is not intended to be used as an aid in determining the scope of the claimed subject matter. The claimed subject matter is not limited to implementations that solve any or all disadvantages noted in the background.

SUMMARY

A fixture has a front frame with a front, a side and a back, wherein the side extends from the front to the back. A side panel holder is mounted next to the front frame such that a wall of the side panel holder covers the back of the front frame proximate an edge where the back of the front frame meets the side of the front frame. A side panel is positioned within the side panel holder.

An end cap display fixture includes a connecting frame mounted to an end of a display fixture such that the connecting frame spans at least a portion of a first base deck, a center wall and at least a portion of a second base deck of the display fixture. A display frame is positioned in front of the connecting frame and a side panel assembly is positioned between the connecting frame and the display frame.

A fixture includes a front frame having slots for supporting a shelving bracket, a back frame, and a canopy plate proximate a top of the front frame and a top of the back frame. A side pegboard holder is positioned between the front frame and the back frame and is mounted to the canopy plate. A pegboard is mounted in the pegboard holder.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Embodiments described below provide an end cap display fixture designed to be mounted to an end of an island retail fixture. The end cap display fixture is a double end frame fixture that includes two spaced apart frames with two side panel holders positioned between the two frames. Each side panel holder holds a panel such as a pegboard that allows pegs to be mounted to the side of the end cap display fixture. The front frame of the end cap provides two uprights with slots to support shelves and a back panel such as a pegboard panel, for example. The front frame is positioned closer to an end of the end cap display fixture to make it easier for customers to reach products supported by the front frame while each side panel holder supports additional products. As a result, some of the product space that would be lost by moving the front frame forward is regained using the side panel holders.

Figure 1:
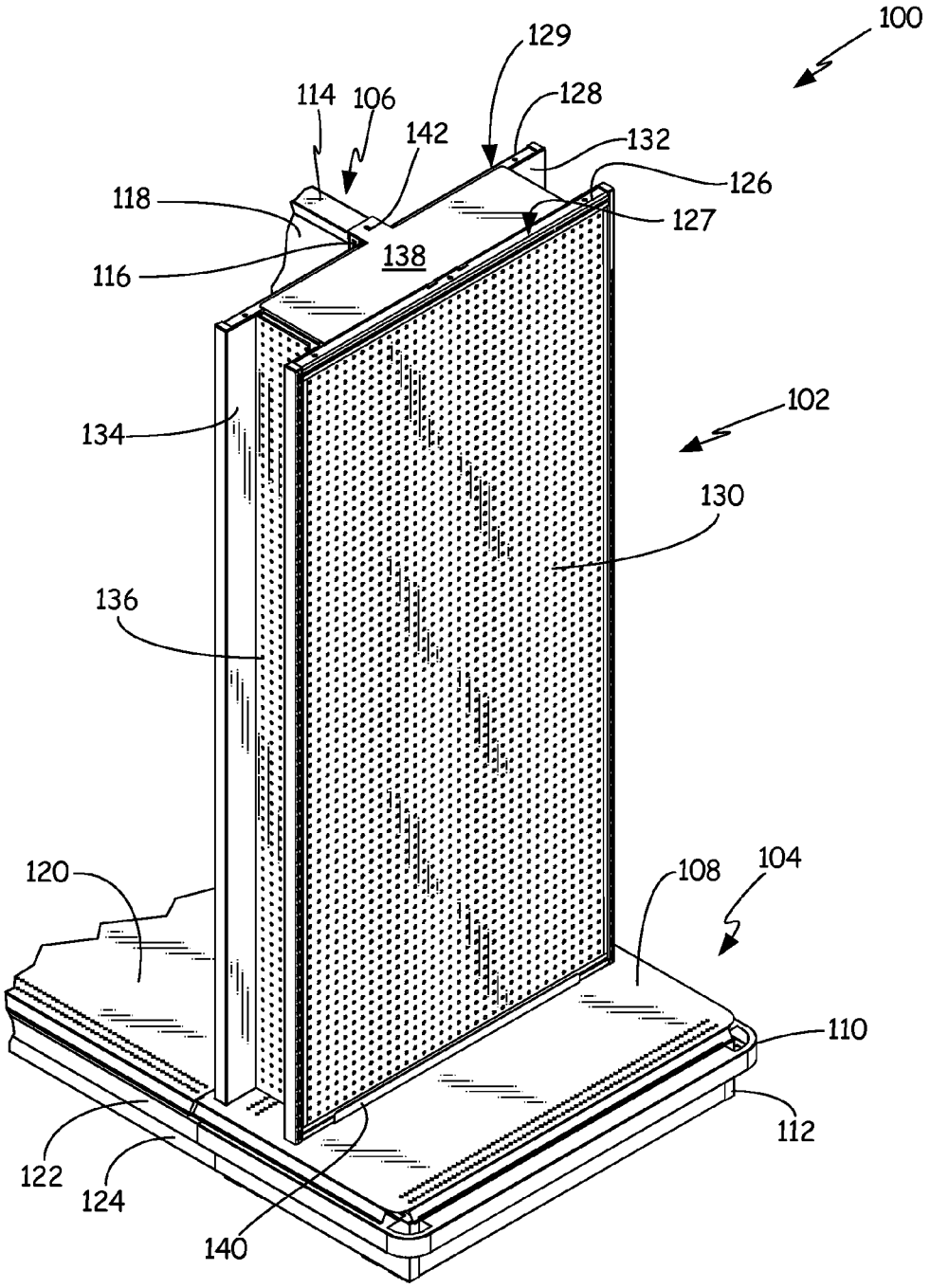
FIG. 1 is a front perspective view of a retail fixture in accordance with one embodiment.

FIG. 1 provides a front perspective view of a display fixture 100. FIGS. 2, 3, 4 and 5 provide a front view, back view, left side view and top view of display fixture 100 with the right side view being the mirror image of the left side view.

Display fixture 100 consists of island display fixture 106 and double end frame display fixture 102. Island display fixture 106 includes base decks 120 and 121, guard 122, base front 124, and center wall 118, which includes upright 116, and top rail 114. Upright 116 includes slots such as slot 300, which can receive shelving brackets to support one or more shelves.

Double end frame display fixture 102 includes a front or display frame 126, a back or connecting frame 128, two side panel holders 132 and 134, a canopy plate 138 and a base stabilizer 140. Front frame 126 includes two uprights 197 and 199 that include slots such as slots 200 and 202 for supporting shelving brackets (not shown). A panel 130 is supported within front frame 126 and a panel 129 is supported within back frame 128. Side panel holders 132 and 134, also referred to as panel holders or side pegboard holders, are positioned between front frame 126 and back frame 128. Side panel holder 134 supports and retains panel or pegboard 136 and side panel holder 132 supports or retains panel or pegboard 416.

Figure 6:
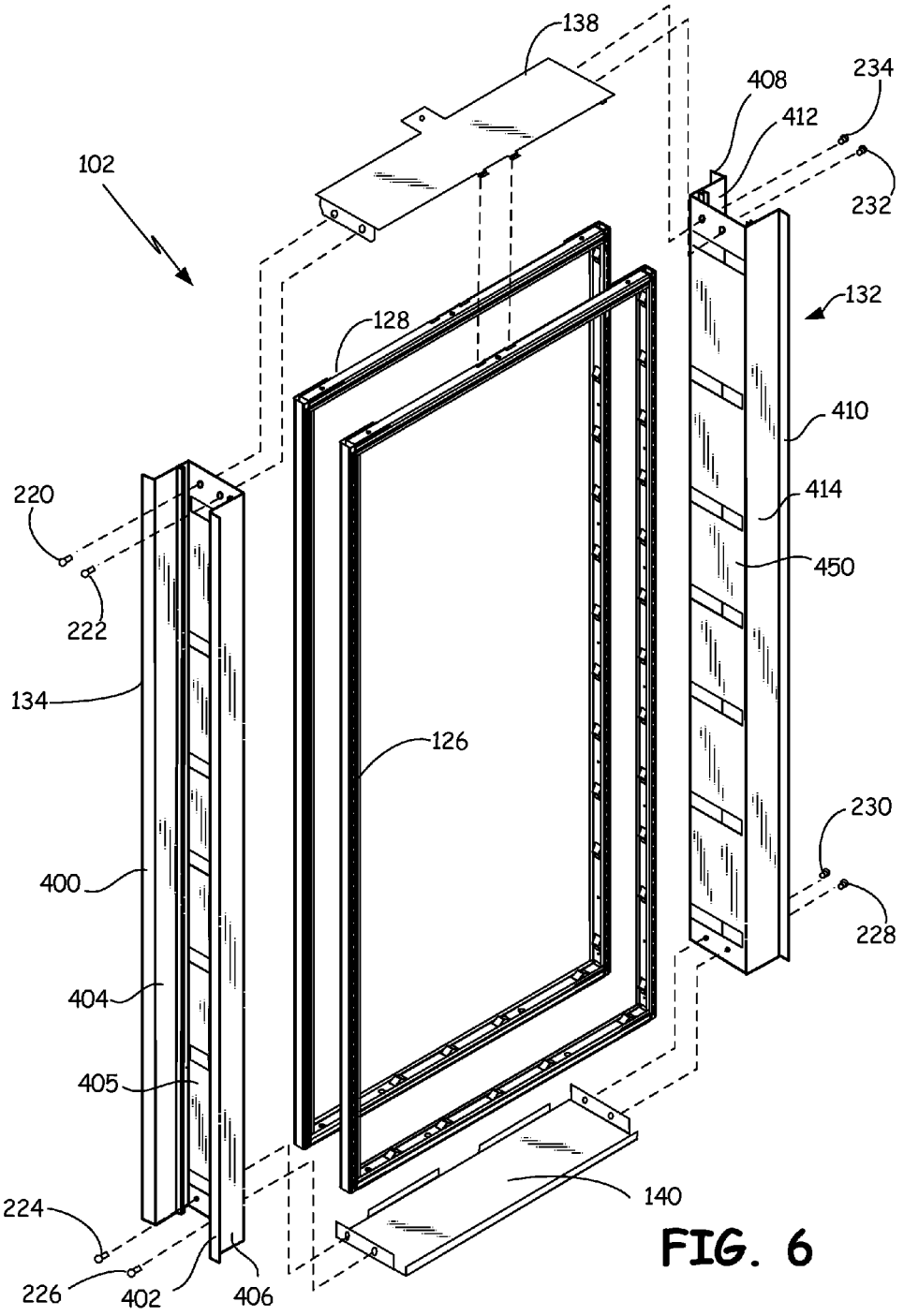
FIG. 6 is a front perspective exploded view of the end cap display fixture of FIG. 1 with panels removed and without the base deck.
Figure 7:
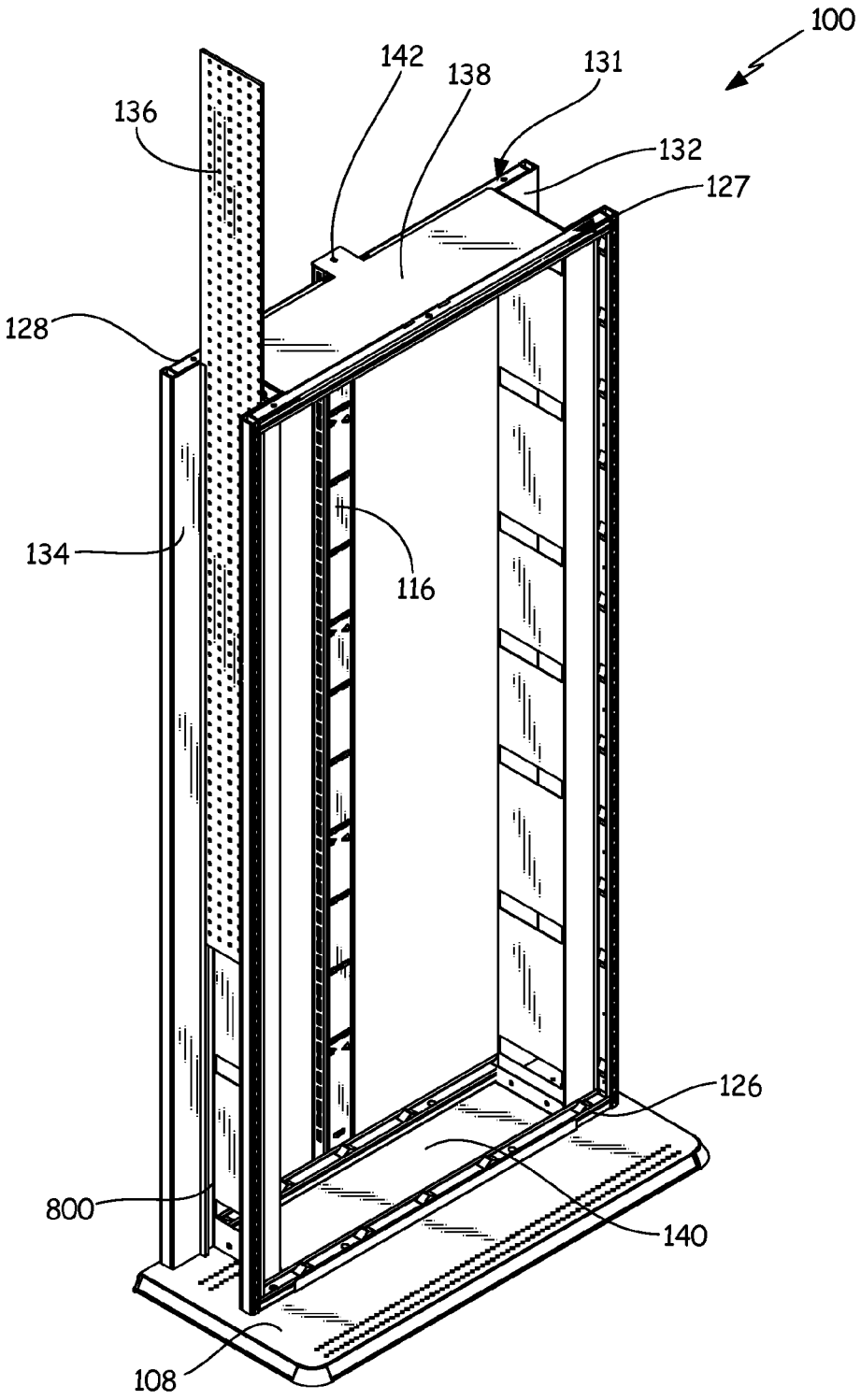
FIG. 7 is a front perspective view of the end cap display fixture of FIG. 1 with a front panel and a back panel removed and a side panel raised.

FIG. 6 provides an exploded front perspective view of double end frame display fixture 102 with panels 129, 130 and 136 removed. FIG. 7 shows a front perspective view of upright 116 and double end frame display fixture 102 with panels 129 and 130 removed and panel 136 in a raised position. As shown in FIGS. 6 and 7, side panel holders 132 and 134 are mounted to canopy plate 138 and base stabilizer 140 by fasteners 220, 222, 224, 226, 228, 230, 232, and 234. Side panel holder 132 includes panel holder front walls 408 and 410, panel holder side walls 412 and 414 and panel holder center wall 405. Side panel holder 134 includes panel holder front walls 400 and 402, panel holder side walls 404 and 406 and panel holder center wall 450. Panel holder front walls 400, 402, 408 and 410 cover the sides of front frame 126 and back frame 128. In addition, panel holder side walls 404, 406, 412 and 414 cover portions of front frame 126 and back frame 128 that face each other.

Figure 5:
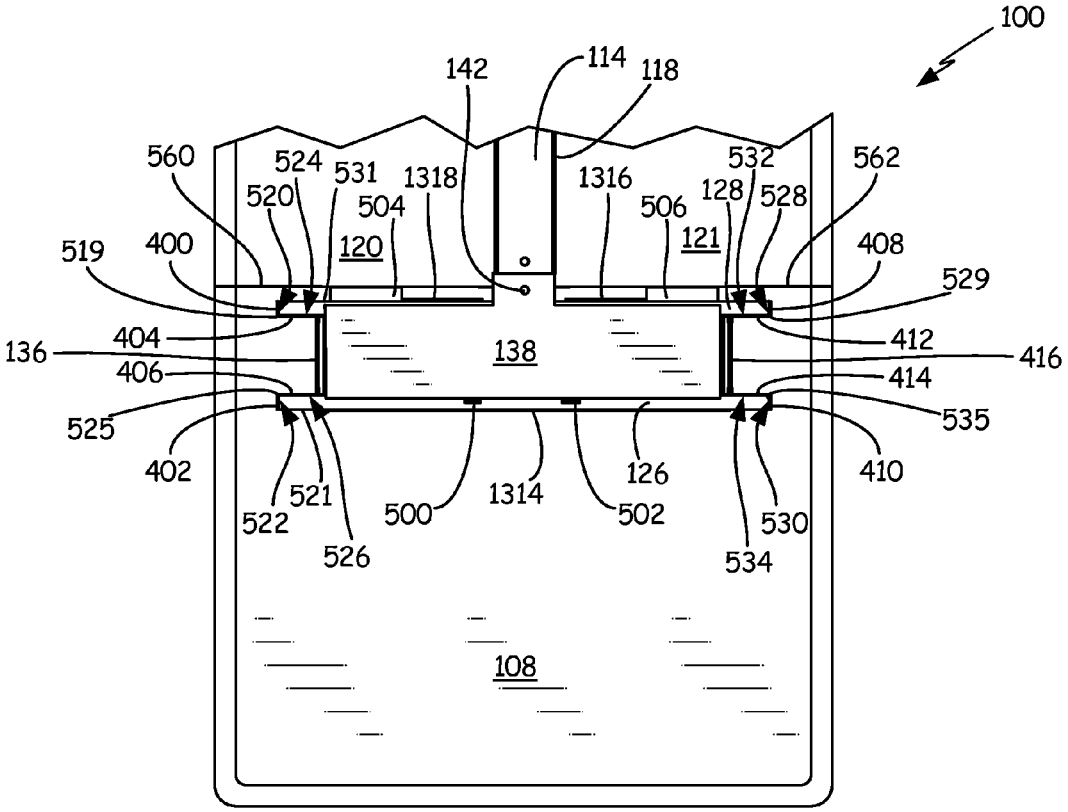
FIG. 5 is a top view of the retail fixture of FIG. 1.

Specifically, as shown in FIG. 5, front frame 126 has a front 521, two sides 522 and 530 and two back portions 526 and 534. Side 522 extends between front 521 and back portion 526 while side 530 extends between front 521 and back portion 534. Panel holder front wall 402 of side panel holder 134 covers side 522 while panel holder front wall 410 of side panel holder 132 covers side 530. Panel holder side wall 406 covers back portion 526 and panel holder side wall 414 covers back portion 534. Specifically, panel holder side wall 406 covers back portion 526 beginning proximate an edge 525 where back portion 526 meets side 522. Similarly, panel holder side wall 414 covers back portion 534 beginning proximate an edge 535 where back portion 534 meets side 530.

Back frame 128 has a back 531, two sides 520 and 528, and two front portions 524 and 532. Side 520 extends between front portion 524 and back 531 while side 528 extends between front portion 532 and back 531. Panel holder front wall 400 of side panel holder 134 covers side 520 while panel holder front wall 408 of side panel holder 132 covers side 528. Panel holder side wall 404 covers front portion 524 and panel holder side wall 412 covers front portion 532. Specifically, panel holder side wall 404 covers front portion 524 beginning proximate an edge 519 where front portion 524 meets side 520. Similarly, panel holder side wall 412 covers front portion 532 beginning proximate an edge 529 where front portion 532 meets side 532.

Thus, side panel holder 132 covers one side of front frame 126 and back frame 128 and portions of front frame 126 and back frame 128 that face each other while side panel holder 134 covers the other side of front frame 126 and back frame 128 and other portions of front frame 126 and back frame 128 that face each other.

As described more fully below, back frame 128 is mounted to upright 116 by inserting a mounting bracket attached to back frame 128 into a hollow center of upright 116. A fastener, such as a hairpin for example, is inserted within upright 116 to maintain the mounting bracket within upright 116. Canopy plate 138, which is inserted into openings 500 and 502 in a top 127 of front frame 126, extends over and is proximate to a top 131 of back frame 128 and is fastened to the hairpin by a fastener 142.

Figure 3:
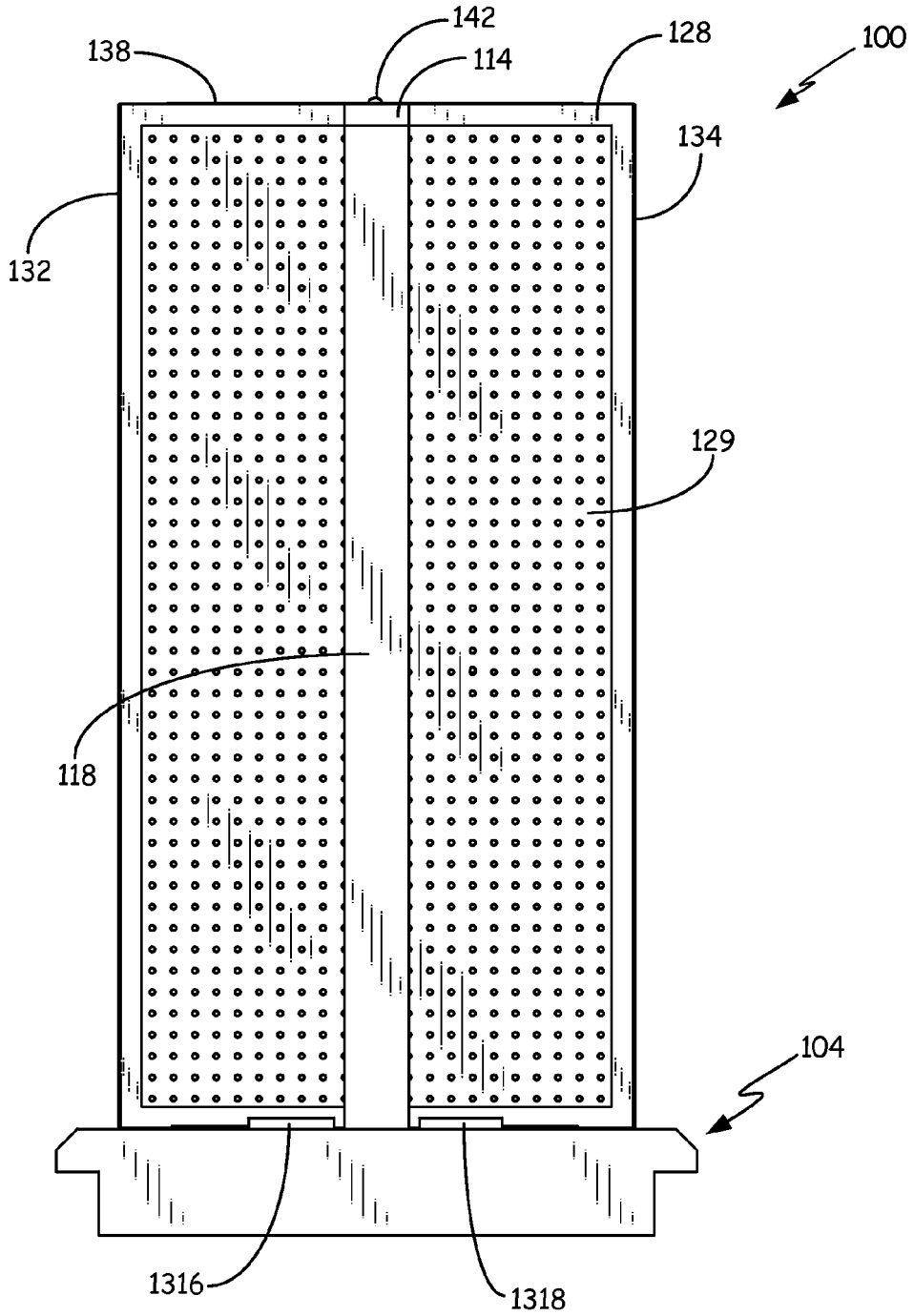
FIG. 3 is a back view of the retail fixture of FIG. 1.
Figure 4:
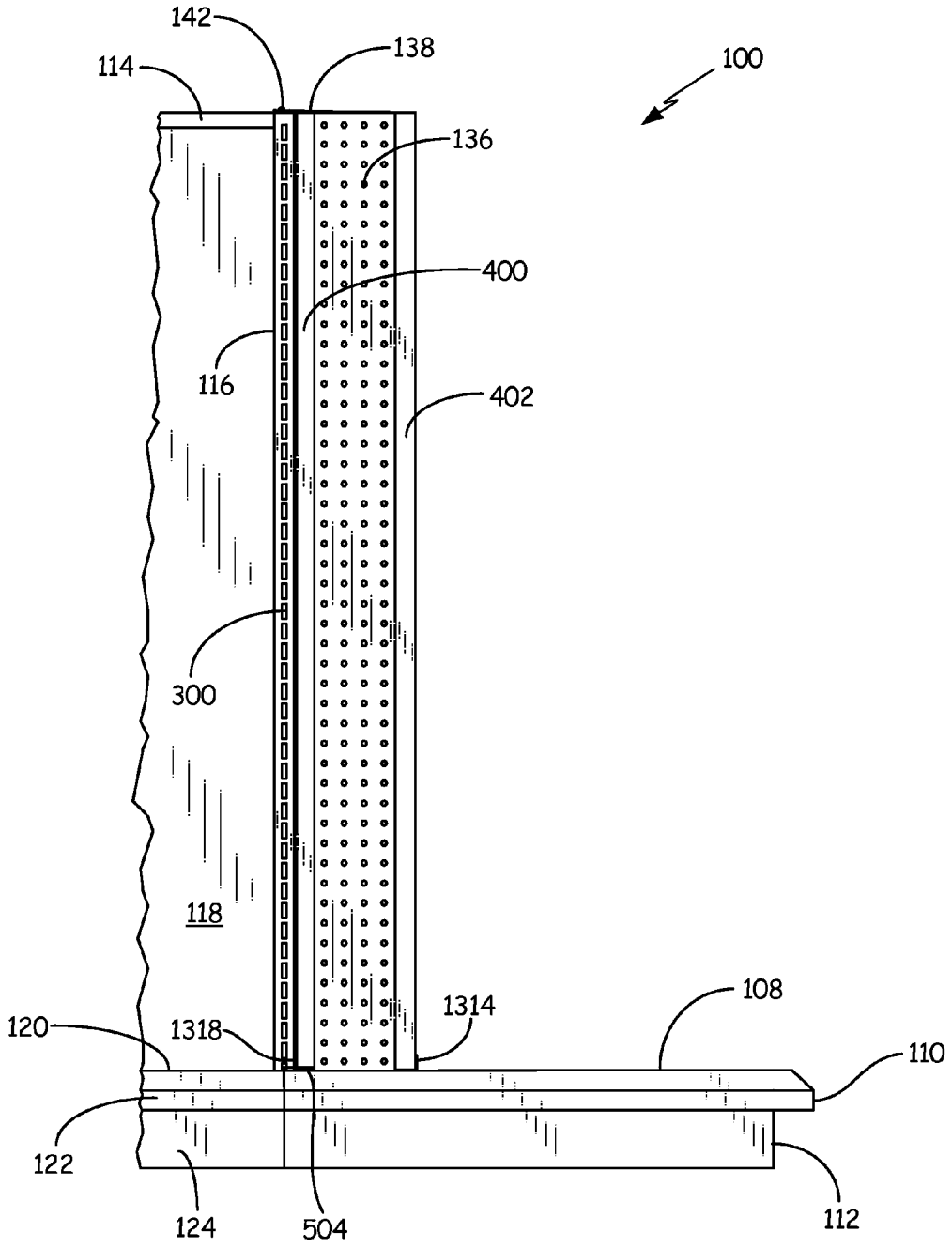
FIG. 4 is a side view of the retail fixture of FIG. 1.

Front frame 126 and back frame 128 rests on base stabilizer or base member 140, which in turn rests on base deck 108. Base deck 108 is separated from base decks 120 and 121 at respective seams 560 and 562. Base stabilizer 140 includes front channel wall 1314 and back channel walls 1316 and 1318 (FIG. 3). Front frame member 126 is installed on base stabilizer 140 such that it is in contact with front channel wall 1314 while back frame 128 is installed on base stabilizer 140 such that it is in contact with back channel walls 1316 and 1318.

Figure 8:
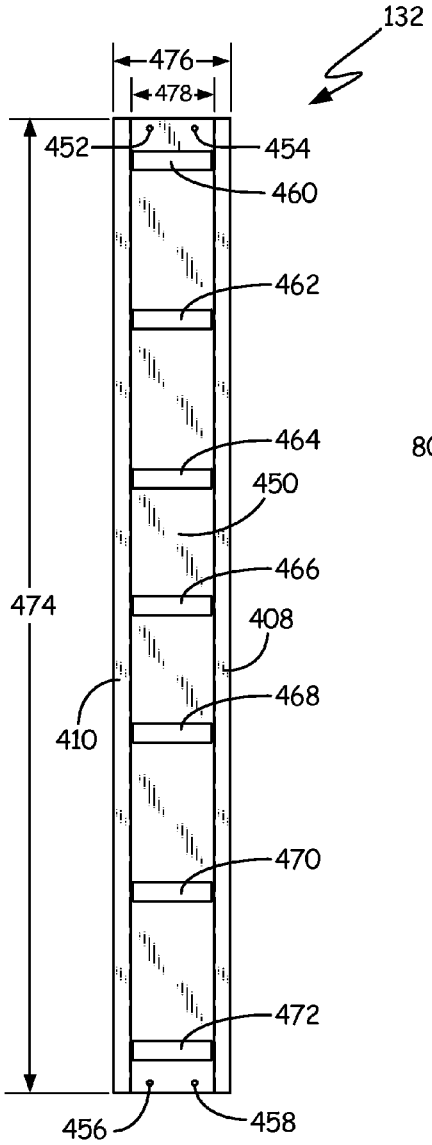
FIG. 8 is a side view of a side panel holder of the retail fixture of FIG. 1.
Figure 9:
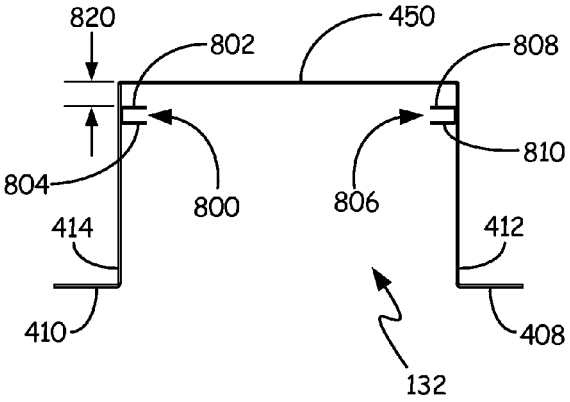
FIG. 9 is a top view of a side panel holder of the retail fixture of FIG. 1.
Figure 10:
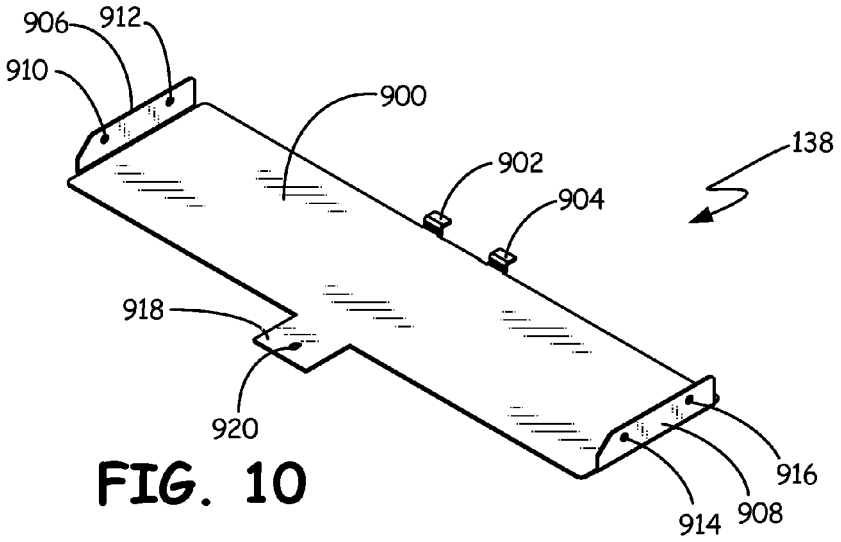
FIG. 10 is a bottom perspective view of the canopy plate of the retail fixture of FIG. 1.
Figure 11:
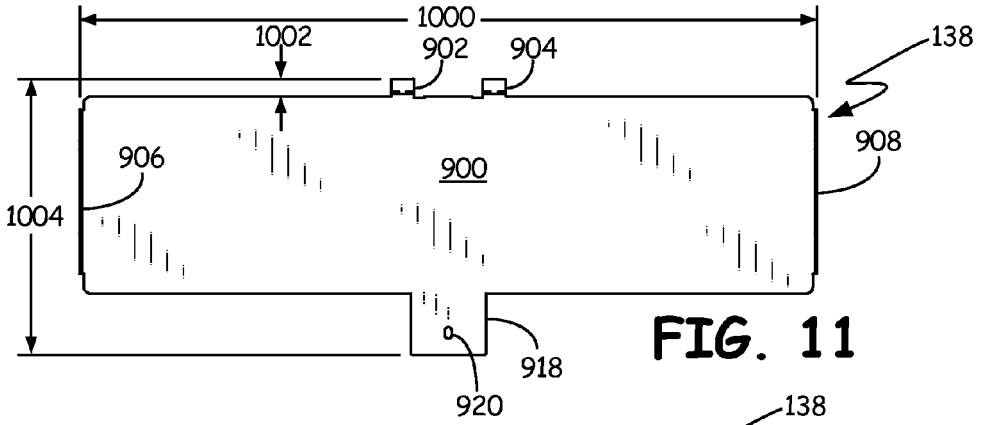
FIG. 11 is a top view of the canopy plate of FIG. 10.
Figure 12:
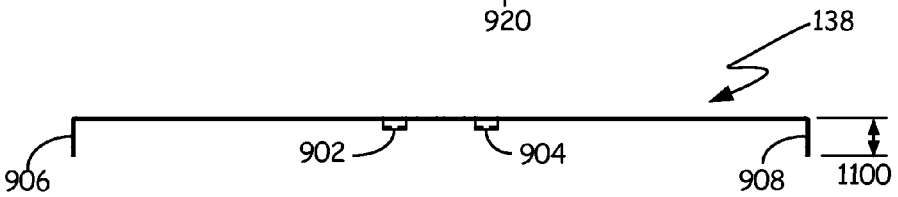
FIG. 12 is a front view of a canopy plate of FIG. 10.
Figure 13:
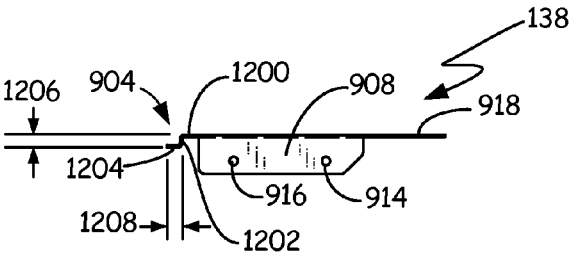
FIG. 13 is a side view of a canopy plate of FIG. 10.
Figure 14:
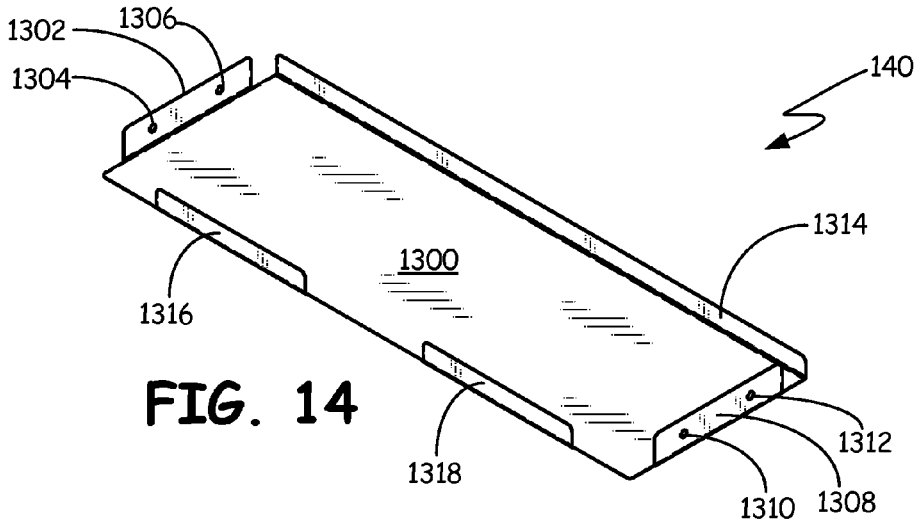
FIG. 14 is a top perspective view of the base stabilizer of the retail fixture of FIG. 1.
Figure 15:
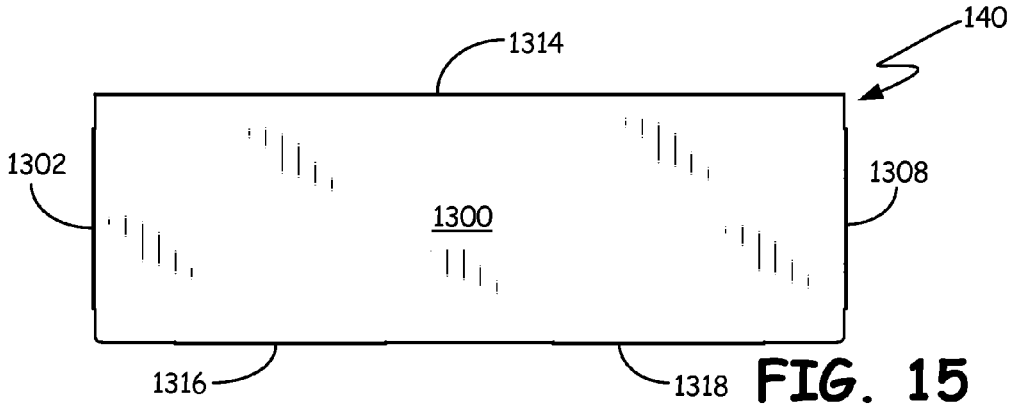
FIG. 15 is a bottom view of the base stabilizer of FIG. 14.
Figure 16:
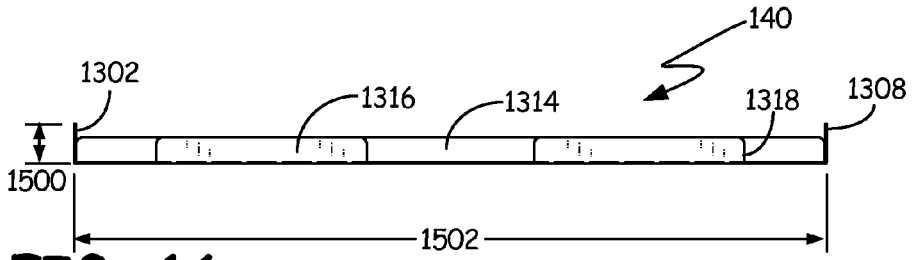
FIG. 16 is a back view of the base stabilizer of FIG. 14.
Figure 17:
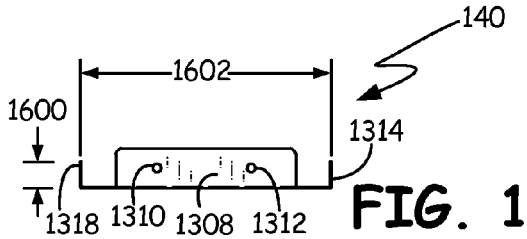
FIG. 17 is a side view of the base stabilizer of FIG. 14.

FIG. 8 shows a side view of side panel holder 132 and FIG. 9 shows a top view of side panel holder 132. Side panel holder 132 includes a panel holder center wall 450 between panel holder side walls 414 and 416 where panel holder center wall 450 is substantially perpendicular to panel holder side walls 414 and 416, in some embodiments. Panel holder side walls 414 and 416 are both integral with and extend forward from panel holder center wall 450. In accordance with some embodiments, panel holder front wall 410 is substantially parallel to panel holder center wall 450 and is integral with and extends from panel holder side wall 414 in a direction away from panel holder center wall 450. Similarly, in accordance with some embodiments, panel holder front wall 408 is substantially parallel to panel holder center wall 450 and is integral with and extends from panel holder side wall 412 in a direction away from panel holder center wall 450. Each of panel holder center wall 450, panel holder side walls 414 and 412 and panel holder front walls 410 and 408 have a height 474 that is substantially similar to the heights of front frame 126, back frame 128 and wall 118 and in some embodiments is substantially 76 and ⅝ inches. Panel holder center wall 450 has a width of 478, which in one embodiment is substantially 6 and 11/16 inches. Side panel holder 132 has an overall width of 476 from an outer edge of panel holder front wall 410 to an outer edge of panel holder front wall 408. In accordance with one embodiment, width 476 is substantially 8 and 5/16 inches.

Panel holder center wall 450 includes rectangular openings 460, 462, 464, 466, 468, 470 and 472, which are evenly distributed along the height of panel holder center wall 450. Panel holder center wall 450 also includes upper fastener openings 452 and 454 and lower fastener openings 456 and 458, which are used to fasten side panel holder 132 to canopy plate 138 and base stabilizer 140, respectively.

Two retainers 800 and 806 are tack-welded to panel holder side walls 414 and 412, respectively, at an offset distance 820 from panel holder center wall 450. In accordance with some embodiments, offset distance 820 is substantially ½ inch. Retainers 800 and 806 receive panel 416 between respective front walls 804 and 810 and respective back walls 802 and 808. As such, the back of panel 416 is located the offset distance 820 from panel holder center wall 450, thereby providing space to accommodate pegs placed through peg holes in panel 416. In accordance with some embodiments, retainers 800 and 806 run the entire height 474 of side panel holder 132. In other embodiments, retainers 800 and 806 are constructed of intermittent portions along height 474.

Side panel holder 134 has a substantially similar construction to side panel holder 132.

FIGS. 10, 11, 12 and 13 provide a bottom perspective view, a bottom view, a front view, and a right side view of canopy plate or top plate 138. Canopy plate 138 includes a top panel or main panel 900 and an extension portion or hairpin cover 918. Hairpin cover 918 is coplanar with top panel or main panel 900 and extends from a back edge of top panel 900. Hairpin cover 918 is designed to cover a hairpin, discussed further below and includes an opening 920 that accepts fastener 142 for fastening to the hairpin.

Two tabs 902 and 904 extend from a front edge of top panel 900 and are designed to be inserted into openings 500 and 502 in the top 127 of front frame 126. Tab 904 includes a horizontal extension 1200 that is coplanar with top panel 900 and extends forward from the front edge of panel 900; a vertical extension 1202 that extends downwardly from horizontal extension 1200; and a tab end 1204 that extends forward from vertical extension 1202. Tab 904 has a tab height 1206 measured from the top of horizontal extension 1200 to the bottom of horizontal extension 1214. In accordance with one embodiment, height 1206 is substantially 15/32 inch. Tab end 1204 extends a distance 1208 from vertical extension 1202, where in one embodiment, distance 1208 is substantially 19/32 inch. Tab 902 has a similar construction to tab 904.

Two holder mounts 906 and 908 extend downwardly from respective sides of top panel 900. Holder mount 906 includes openings 910 and 912 that accept a fastener for fastening a top of panel holder 134 to canopy plate 138. Holder mount 908 includes openings 914 and 916 which accept a fastener to mount side panel holder 132 to canopy plate 138. In particular, opening 916 is aligned with upper fastener opening 452 of side panel holder 132 and opening 914 is aligned with upper fastener opening 454 of side panel holder 132 and respective fasteners are passed through the aligned openings.

Canopy plate 138 has a length 1004 and a width 1000 such that canopy plate 138 covers a portion of front frame 126, extends over back frame 128 and extends between side panel holder 132 and side panel holder 134. In accordance with one embodiment, length 1004 is substantially 11 and 27/32 inches and width 1000 is substantially 30 and 7/8 inches. Tabs 902 and 904 extend a distance 1002 from a front edge of top panel 900 that is sufficient for the tabs to be inserted into openings 500 and 502 in front frame 126. In accordance with one embodiment, distance 1002 is substantially 31/32 inch. Holder mounts 906 and 908 extend downward a distance 1100 from top panel 900. In accordance with one embodiment, distance 1100 is substantially 1 and 1/2 inches.

FIGS. 14, 15, 16 and 17 show a top perspective view, a top view, a back view, and a left side view of base stabilizer 140. Base stabilizer 140 includes a bottom panel 1300, a front channel wall 1314, back channel walls 1316 and 1318 and holder mounts 1302 and 1308. Front channel wall 1314 extends upward along an entire extent of a front edge of bottom panel 1300. Back channel walls 1316 and 1318 both extend upward along respective portions of a back edge of bottom panel 1300. Holder mounts 1302 and 1308 extend upward along respective sides of bottom panel 1300. Base stabilizer 140 has a length 1602 such that base stabilizer 140 extends beneath front frame 126 and back frame 128 and base stabilizer 140 has a width such that base stabilizer 140 extends from side panel holder 132 to side panel holder 134. In accordance with one embodiment, width 1502 is substantially 28 and 5/32 inches and length 1602 is substantially 9 and 13/32 inches. Holder mounts 1302 and 1308 extend a height 1500 above bottom panel 1300 while front channel wall 1314 and back channel walls 1316 and 1318 extend a height 1600 above bottom panel 1300. In accordance with one embodiment, height 1500 is substantially 1 and 1/2 inch and height 1600 is substantially 1 inch.

Holder mount 1302 includes openings 1304 and 1306, which receive fasteners to fasten holder mount 1302 to base stabilizer 140. In particular, opening 1304 is aligned with lower fastener opening 458 of side panel holder 132 and opening 1306 is aligned with lower fastener opening 456 of side panel holder 132. Respective fasteners are then passed through the aligned openings to thereby mount side panel holder 132 to base stabilizer 140. Similarly, openings 1310 and 1312 in holder mount 1308 are aligned with openings in the bottom of side panel holder 134 and fasteners are passed through the respective aligned openings to thereby mount side panel holder 132 to base stabilizer 140.

Figure 2:
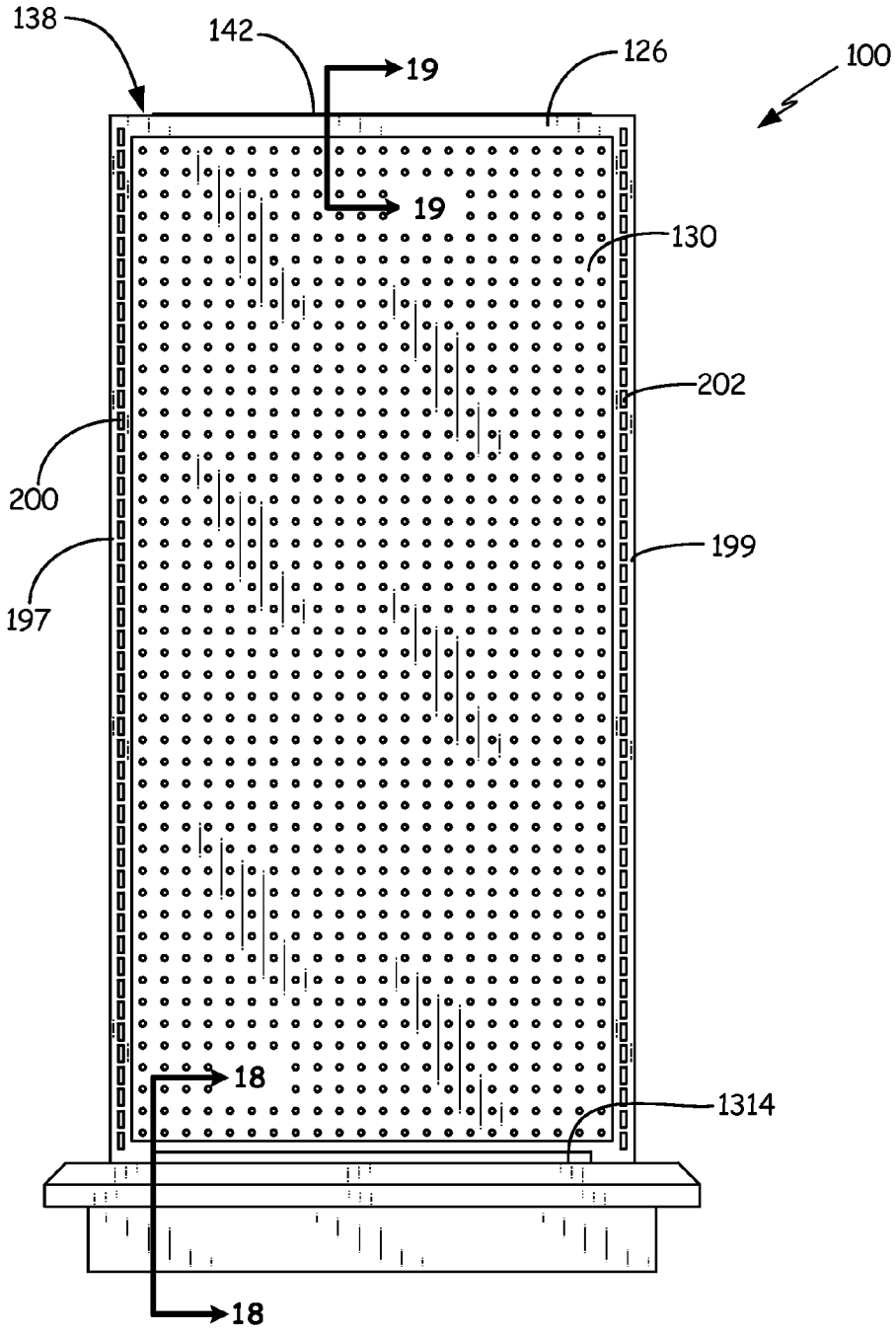
FIG. 2 is a front view of the retail fixture of FIG. 1.
Figure 18:
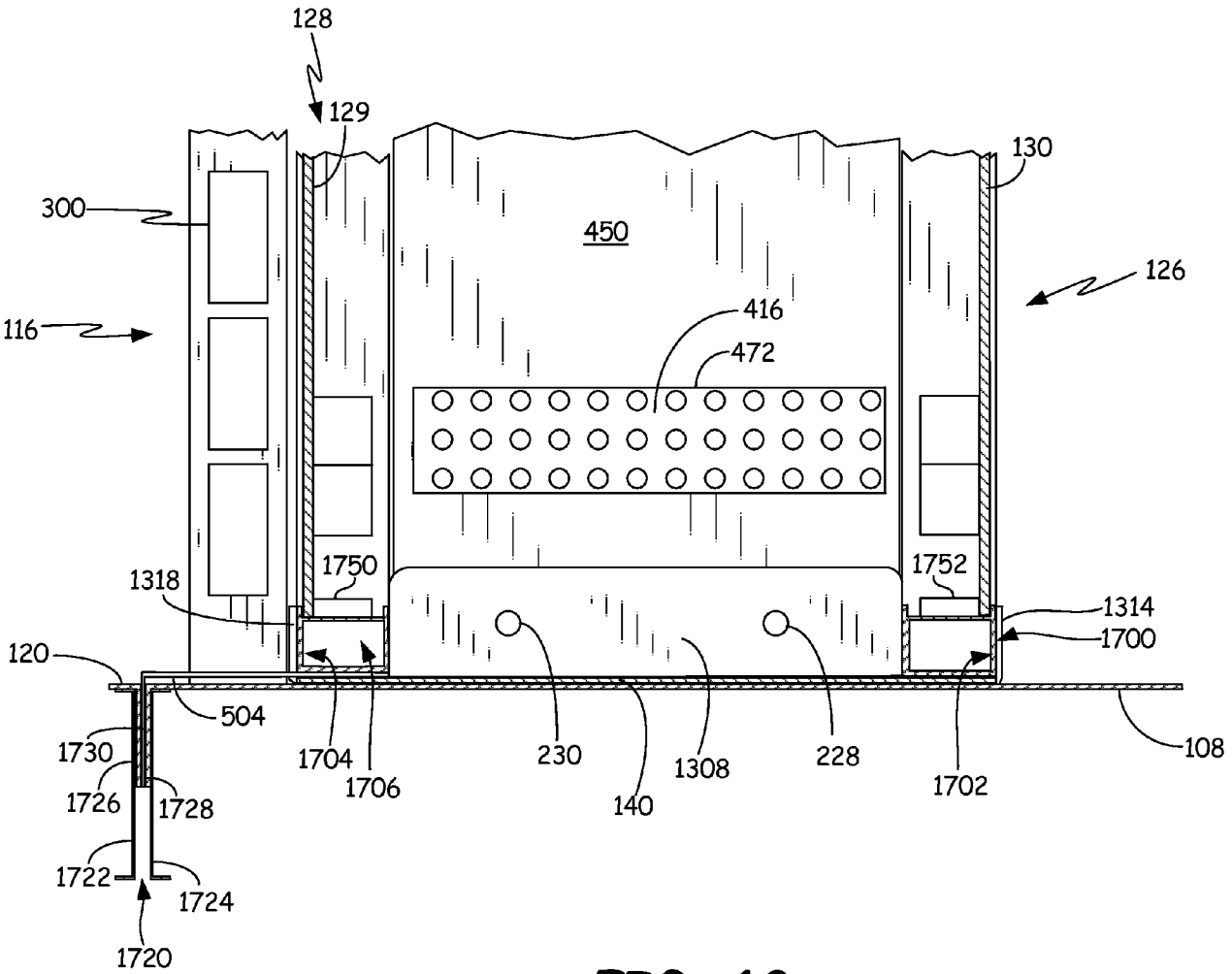
FIG. 18 is a cross-sectional side view of a portion of the retail fixture of FIG. 1

FIG. 18 shows an enlarged sectional view taken along lines 18-18 of FIG. 2 showing a bottom portion of fixture 100. In FIG. 18, front frame 126 and back frame 128 are shown to be positioned on top of base stabilizer 140 such that a wall 1700 of a bottom rail 1702 of front frame 126 is in contact with front channel wall 1314 while a back wall 1704 of a bottom rail 1706 of back frame 128 is in contact with back channel wall 1318 and back channel wall 1316 (not shown). As shown in FIG. 18, panel 130 is held in place in front frame 126 by a series of clips such as clip 1732 and walls such as wall 1700. Similarly, panel 129 is held in place between a series of clips such as clip 1750 and walls such as back wall 1704.

In FIG. 18, panel holder center wall 450 of side panel holder 132 is shown to be fastened or mounted to holder mount 1308 of base stabilizer 140 by two fasteners 228 and 230.

A base bracket 1720, which supports base decks 120 and 108, includes bracket walls 1722 and 1724. Downwardly extending legs 1726 and 1728 of respective base decks 120 and 121 extend between bracket walls 1722 and 1724 and in some embodiments are held in place by spring force between bracket walls 1722 and 1724. Base bracket 1720 is designed to rest on a floor and may have one or more feet (not shown) that extend downward from base bracket 1720 to contact the floor. A mounting bracket 504, which is attached to the bottom of back frame 128 includes a downward extending leg 1730 that extends between downwardly extending leg 1726 and downwardly extending leg 1728 and thereby prevents forward or backward movement of the bottom of double end frame display fixture 102 along base deck 108. In accordance with some embodiments, mounting bracket 504 may not be present.

Figure 19:
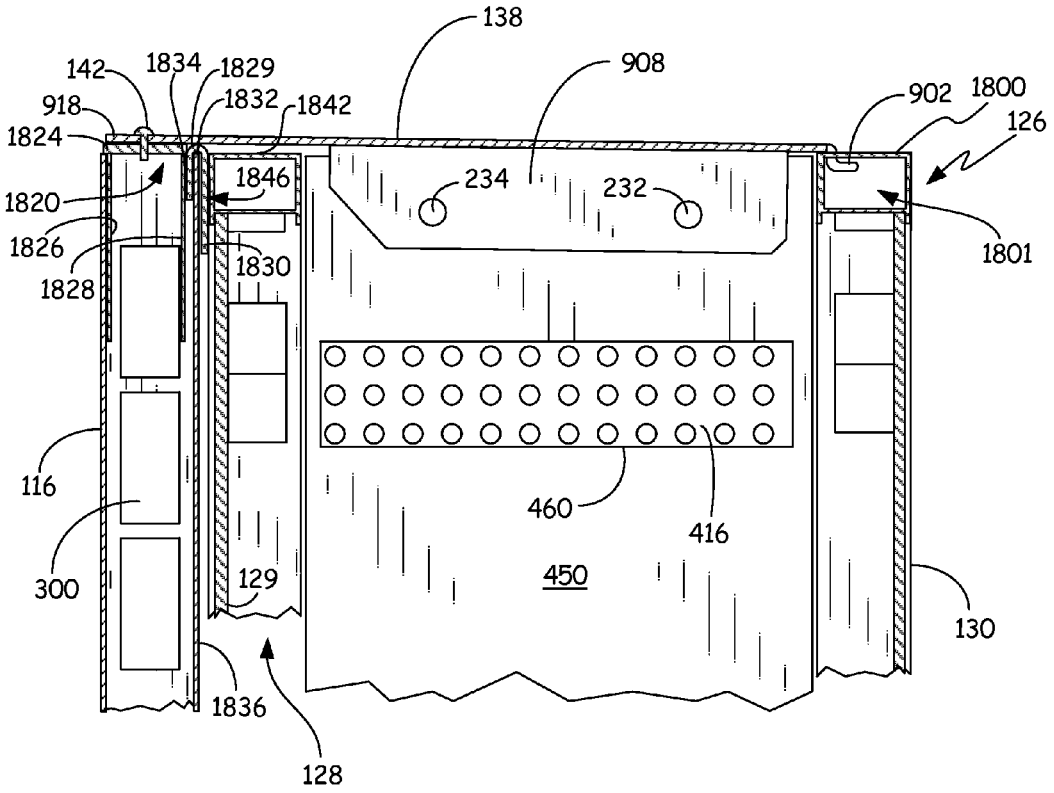
FIG. 19 is a cross-sectional side view of a portion of the retail fixture of FIG. 1.

FIG. 19 shows an enlarged sectional view of fixture 100 taken along lines 19-19 of FIG. 2. In FIG. 19, panel holder center wall 450 is shown as being fastened to canopy plate 138 by fasteners 232 and 234, which are attached to holder mount 908.

Tab 902 of canopy plate 138 is shown as being within a hollow core 1801 of top rail 1800 of front frame 126. Top panel 900 of canopy plate 138 extends over and is proximate to a top of top rail 1842 of back frame 128 and hairpin cover 918 extends over a hairpin 1820 located within upright 116.

A frame attachment portion 1830 of a mounting bracket 1846 is fastened to top rail 1842 of back frame 128. Mounting bracket 1846 includes a bend 1829 that extends from frame attachment portion 1830 and that is positioned over a top 1832 of a wall 1836 of upright 116. A downwardly extending leg 1834 extends downwardly from bend 1829 and into an interior of upright 116.

Hairpin 1820 includes a top 1824 and two downwardly extending legs 1826 and 1828. Hairpin 1820 is sized such that downwardly extending leg 1834 of mounting bracket 1836 deflects downwardly extending leg 1828 of hairpin 1820 creating a frictional fit between hairpin 1820, mounting bracket 1846, and the interior surfaces of upright 116. A fastener 142 passes through opening 920 in hairpin cover 918 and into hairpin 1820. Thus, front frame 126 is connected to upright 116 through canopy plate 138, fastener 142, and hairpin 1820.

Figure 20:
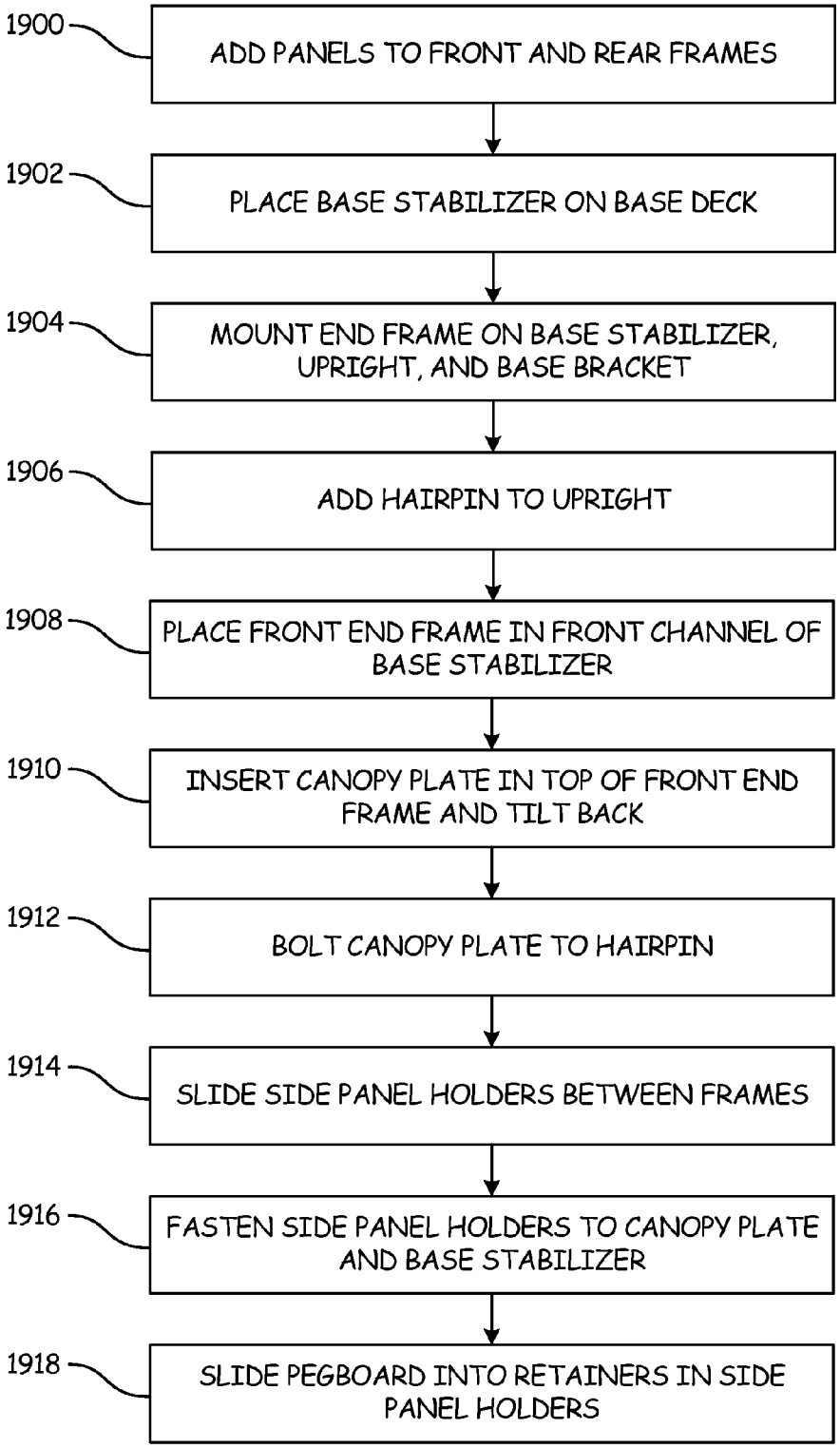
FIG. 20 is a flow diagram of a method of assembling the retail fixture of FIG. 1.

FIG. 20 provides a method of assembling double end frame display fixture 102 to island display fixture 106 to form display fixture 100.

At step 1900, panel 130 is added to front frame 126 and panel 129 is added to back frame 128. These panels may be added by flexing the panels and inserting their edges between the clips and the front and back walls of the respective frames. At step 1902, the base stabilizer 140 is placed on the base deck 108. At step 1904, back end frame 128 is mounted on base stabilizer 140, upright 116 and base bracket 1720. In particular, downwardly extending leg 1834 of mounting bracket 1846 is slid into the interior of upright 116 while downwardly extending leg 1730 of mounting bracket 504 is slid between downwardly extending legs 1726 and 1728 within base bracket 1720 until the bottom of back frame 128 contacts back panel 1300 of base stabilizer 140 next to back channel walls 1316 and 1318.

At step 1906, hairpin 1820 is inserted into the top of upright 116 to thereby secure mounting bracket 1846 within upright 116.

At step 1908, front end frame 126 is placed on top of base stabilizer 140 such that front channel wall 1314 is in contact with a bottom rail of front frame 126. At step 1910, tabs 902 and 904 of canopy plate 138 are inserted into holes 500 and 502 in the top 127 of front frame 126 and canopy plate 138 is tilted back onto hairpin 1820. At step 1912, fastener 142 is used to bolt canopy plate 138 to hairpin 1820.

At step 1914, side panel holders 132 and 134 are inserted between front frame 126 and back frame 128. At step 1916, each side panel holder is fastened to canopy plate 138 and base stabilizer 140 using the holder mounts on canopy plate 138 and base stabilizer 140. At step 1918, panels or pegboards are slid within the retainers in side panel holders 132 and 134 in a downward fashion.

Though elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A fixture comprising:

a front frame having a front, a side and a back, wherein the side extends from the front to the back;

a side panel holder mounted next to the front frame such that a wall of the side panel holder covers the back of the front frame proximate an edge where the back of the front frame meets the side of the front frame; and a side panel positioned within the side panel holder; and wherein the side panel holder comprises two panel retainers and a center wall spaced apart from the two panel retainers, the side panel positioned in the two panel retainers such that the side panel is spaced apart from the center wall.

2. The fixture of claim 1 further comprising a back frame having a front, a side and a back, wherein a second wall of the side panel holder covers the front of the back frame proximate an edge where the front of the back frame meets the side of the back frame.

3. The fixture of claim 2 wherein the two panel retainers comprise a panel retainer on the wall of the side panel holder and a second panel retainer on the second wall of the side panel holder.

4. The fixture of claim 3 wherein the center wall is between the wall and the second wall.

5. The fixture of claim 2 wherein the back frame is mounted to an upright having at least one slot for supporting a shelf.

6. The fixture of claim 2 further comprising a base stabilizer positioned beneath the front frame and the back frame and having at least one holder mount to which the side panel holder is mounted.

7. The fixture of claim 2 further comprising a canopy plate coupled to a top of at least one of the front frame and the back frame and having at least one holder mount to which the side panel holder is mounted.

8. The fixture of claim 1 wherein the front frame has a second side and the fixture further comprises:

a second side panel holder mounted next to the front frame such that a wall of the second side panel holder covers the back of the front frame proximate an edge where the back of the front frame meets the second side of the front frame; and a second side panel positioned within the second side panel holder.

9. An end cap display fixture comprising:

a connecting frame mounted to an end of a display fixture such that the connecting frame spans at least a portion of a first base deck, a center wall and at least a portion of a second base deck of the display fixture;

a display frame positioned in front of the connecting frame; and a side panel assembly positioned between the connecting frame and the display frame, wherein the side panel assembly comprises a side panel holder and a side panel; and wherein the side panel holder comprises two panel retainers and a center wall spaced apart from the two panel retainers, the side panel positioned in the two panel retainers such that the side panel is spaced apart from the center wall.

10. The end cap display fixture of claim 9 further comprising a base member positioned beneath the connecting frame and the display frame, wherein the base member is attached to the side panel holder.

11. The end cap display fixture of claim 10 further comprising a top plate positioned proximate a top of the connecting frame and a top of the display frame, wherein the top plate is attached to the side panel holder.

12. The end cap display fixture of claim 9 wherein the side panel holder comprises a first front wall that covers a side of the connecting frame and a second front wall that covers a side of the display frame.

13. The end cap display fixture of claim 9 further comprising a second side panel assembly positioned between the connecting frame and the display frame.

14. A fixture comprising:

a front frame having slots for supporting a shelving bracket;

a back frame spaced apart from the front frame;

a canopy plate proximate a top of the front frame and a top of the back frame;

a side pegboard holder positioned between the front frame and the back frame and having a center wall mounted to the canopy plate; and a pegboard mounted in the pegboard holder; and wherein the side pegboard holder covers a side of the front frame and a portion of a back of the front frame and wherein the side pegboard holder covers a side of the back frame and a portion of a front of the back frame.

15. The fixture of claim 14 wherein the canopy plate further comprises a mounting section for mounting to a display fixture.

16. The fixture of claim 14 further comprising a base stabilizer positioned below both the front frame and the back frame and mounted to the side pegboard holder.

17. The fixture of claim 14 wherein the canopy plate comprises tabs inserted in the top of the front frame.

* * * * *